US005295888A

United States Patent [19]

Tsutsumi

[11] Patent Number: 5,295,888

[45] Date of Patent: Mar. 22, 1994

[54] SAVING BOX

[75] Inventor: Teruhiro Tsutsumi, Hamamatsu, Japan

[73] Assignee: Shintowa Industry, Co., Ltd., Shizuoka, Japan

[21] Appl. No.: 93,357

[22] Filed: Jul. 16, 1993

[30] Foreign Application Priority Data

Jul. 30, 1992 [JP] Japan ..... 4-064192[U]

[51] Int. Cl.[5] ..... A45C 1/12

[52] U.S. Cl. ..... 446/10; 232/5

[58] Field of Search ..... 446/8-13, 446/241; 232/4 R, 5, 1 D

[56] References Cited

U.S. PATENT DOCUMENTS

| | | | |
|---|---|---|---|
| 944,038 | 12/1909 | Huyck et al. | 446/8 |
| 2,213,915 | 9/1940 | Katz | 446/241 X |
| 2,218,431 | 10/1940 | McGee | 446/8 |
| 3,242,931 | 3/1966 | Wandrey | 232/5 X |
| 5,055,079 | 10/1991 | Hobson et al. | 446/8 |

*Primary Examiner*—Mickey Yu
*Attorney, Agent, or Firm*—Darby & Darby

[57] ABSTRACT

A saving box has a cylindrical box body with a closed bottom, a plurality of coin reservoirs each having a different diameter and formed on the closed bottom at proper spaces in a predetermined direction in order of diameter, a sorting disc acting as an upper surface of the box body and provided with a plurality of openings corresponding to the coin reservoirs, a guide sleeve formed within the box body at a central portion thereof and having a vertical groove, an operating rod engaging with the vertical groove and extending upwardly of the box body, a coil spring disposed within the guide sleeve and normally biasing the operating rod upwardly, a moving blade slightly contacting an upper surface of the sorting disc and engaging a spiral groove formed in an outer peripheral surface of the operating rod, an outer surface disc overlaid on and spaced away, by a predetermined distance, from an upper surface of the moving blade and having a coin insertion port, and a soft formative substance having a proper form mounted on the surface disc, an upper extension end of the operating rod being in opposite relation to an inner surface of a top portion of the soft formative substance.

6 Claims, 1 Drawing Sheet

SAVING BOX

BACKGROUND OF THE INVENTION

1. Field of the Invention

This invention relates to a saving box in which various kinds of coins are sorted and saved separately.

2. Brief Description of the Prior Art

Many types of saving boxes in the sense of structure and design are heretofore known. Since there are so many types of them already known to us, it seems that there is almost no new area where further development is to be made. As a method for sorting coins, there are shape sorting, weight sorting, and material sorting, wherein the coins are sorted in accordance with shape, weight and material.

From our long experiences that the saving boxes are regarded as something very familiar to our daily life, we learn that saving boxes, which are simple in structure, easy to handle, and unique in appearance, tend to receive more attention than those which are elaborated in-technique and complicated in structure.

SUMMARY OF THE INVENTION

It is therefore an object of the present invention to provide, in order to cope with the above-mentioned tendency, a saving box which is simple in structure, easy to handle, and attractive in appearance.

Another object of the present invention is to provide a saving box which makes every one feel something close to himself in daily life and which enriches the daily life.

To achieve the above objects, according to the present invention, there is provided a saving box comprising a cylindrical box body having a closed bottom, a plurality of coin reservoirs each having a different diameter and formed on the closed bottom at proper spaces in a predetermined direction in order of diameter, a sorting disc acting as an upper surface of the box body and provided with a plurality of openings corresponding to the coin reservoirs, a guide sleeve formed within the box body at a central portion thereof and having a vertical groove, an operating rod engaging with the vertical groove and extending upwardly of the box body, spring means disposed within the guide sleeve and normally biasing the operating rod upwardly, moving blade means slightly contacting an upper surface of the sorting disc and engaging a spiral groove formed in an outer peripheral surface of the operating rod, an outer surface disc overlaid on and spaced away, by a predetermined distance, from an upper surface of the moving blade means and having a coin insertion port, and a soft formative substance having a proper form mounted on the surface disc, an upper extension end of the operating rod being in opposite relation to an inner surface of a top portion of the soft formative substance.

The above and other objects and further features and advantages of the present invention will become more manifest to those skilled in the art upon a reading of the following detailed description with reference to the accompanying drawings.

DETAILED DESCRIPTION OF THE EMBODIMENT

Figure 1:
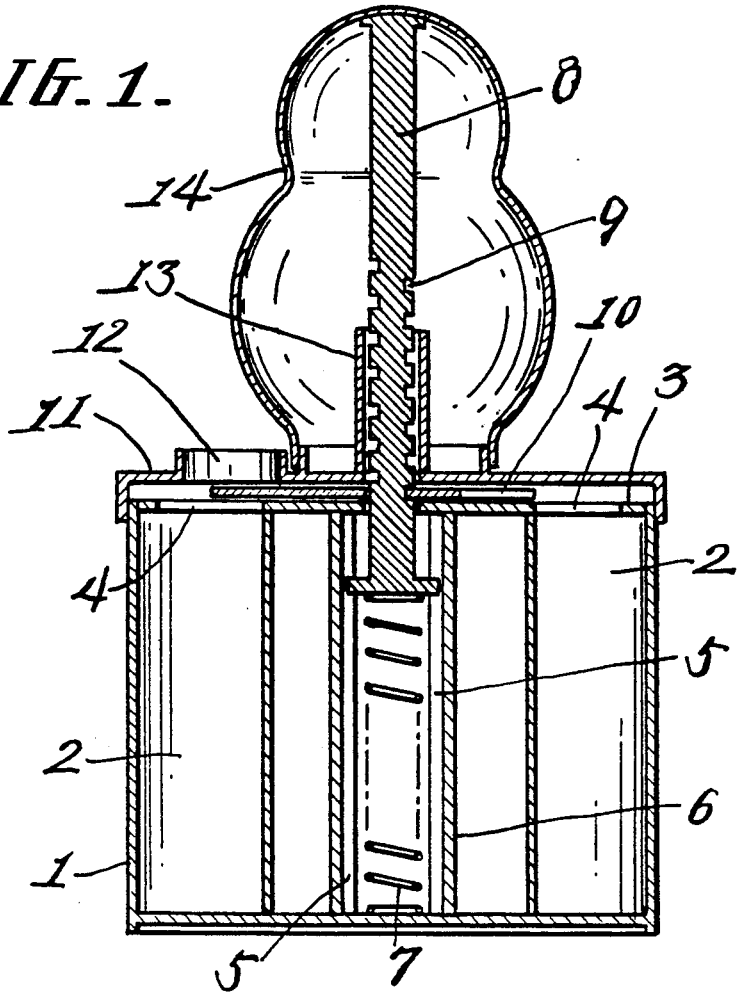
FIG. 1 is a centrally vertical cross-sectional front view of a saving box according to one embodiment of the present invention.
Figure 2:
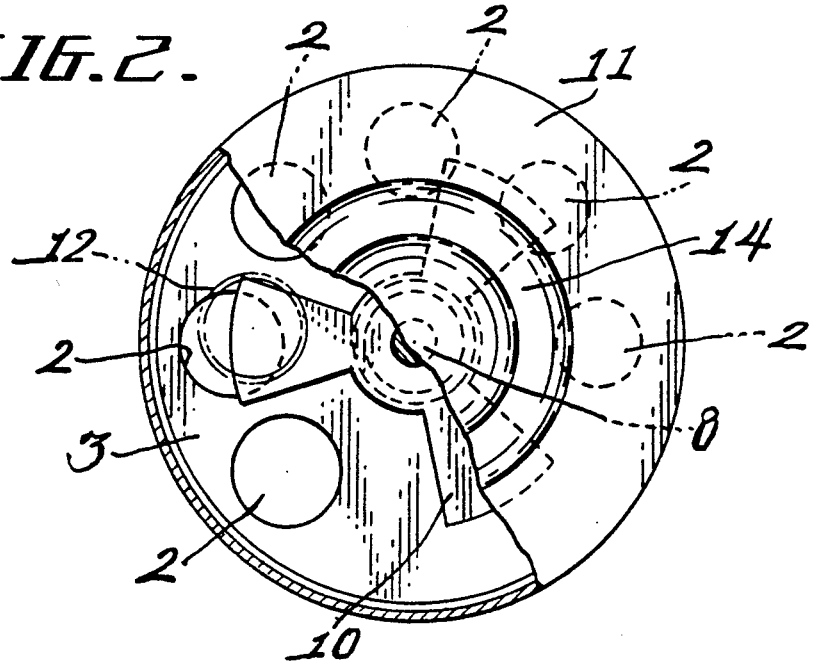
FIG. 2 is a partly cutaway plan view of the above.

One preferred embodiment of the present invention will now be described in detail with reference to the accompanying drawings.

In the drawings, reference numeral 1 denotes a cylindrical box body having a closed bottom. A plurality of vertically communicating coin reservoirs 2 extending along an inner wall of the box body 1 are formed at predetermined spaces on the closed bottom within the box body 1. A sorting disc 3 acting as an upper surface of the box body 1 is provided with a plurality of openings 4 which correspond to the coin reservoirs 2, respectively. Each coin reservoir 2 has a different diameter, and the coin reservoirs 2 are arranged in a predetermined direction in order of diameter.

A guide sleeve 6 having a vertical groove 5 is formed at a central portion within the box body 1. An operating rod 8 extending upwardly of the box body 1 is fitted into the guide groove 5 while engaging with the vertical groove 5, and normally biased upwardly by spring means 7 such as a coil spring.

A spiral groove 9 is formed in an outer periphery of the operating rod 8. A moving blade means 10 is normally engaged with the spiral groove 9 and lightly contacted with an upper surface of the sorting disc 3. In this embodiment, the blade means 10 is comprised of three blades, but the number of the blades is not limited to three. In other words, the number of the blades may be single or plural.

A surface disc 11 is overlaid on an upper surface of the moving blade means 10 so that the moving blade means 10 is prevented from being raised upwardly. A coin insertion port 12 is formed in a predetermined location of the surface disc 11, and a sleeve 13 for preventing the sway of the operating rod 8 is provided to a central portion of the surface disc 11, so that vertical movement of the operating rod 8 is protected.

A soft formative substance 14 is mounted on the upper surface of the surface disc 11. The operating rod 8 extending through the formative substance 14 is placed at its extension end opposite to an inner surface of a top portion of the formative substance 14. This formative substance 14 may be selected from animals, dolls, etc.

With the above-mentioned construction of the present invention, the operating rod 8 is in its uppermost position when a coin is not inserted. It is designed such that the coin insertion port 12 of the surface disc 11 is not in alignment with the openings 4 of the sorting disc 3.

When a particular coin is inserted into the coin insertion port 12 and the top portion of the formative substance 14 is pushed down (the operating rod may be pushed down first and then the coin may be inserted), the formative substance is compressed to change its original shape and the operating rod 8 is lowered downwardly along the vertical groove 5 within the guide sleeve 6 against the resiliency of the spring means 7. In accordance with the downward movement of the operating rod 8, the moving blade means 10 engaged with the spiral groove 9 is rotated to move the coin inserted through the coin insertion port 12 in a planar direction on the sorting disc 3 and finally drop the coin down into one of the coin reservoirs 2 the diameter of which corresponds to that of the coin. At that time, when the downward pressure to the operating rod 8 is released, the distal end of the operating rod 8 is returned to its uppermost position under the influence of the spring means 7 as the deformed formative substance 14 recovers its original shape.

During the course of compression and recovery of the formative substance 14 in accordance with the downward and returning movements of the operating rod 8, the formative substance 14, which resembles, for example, an animal or a doll, is changed in shape, appearance, etc. This change in shape, appearance, etc. of the formative substance 14 immensely attracts the attention of the user when the coin is being inserted.

In the drawings, decorative designs to be applied to the formative substance 14 are omitted.

As described in the foregoing, a saving box according to the present invention comprises a cylindrical box body having a closed bottom, a plurality of coin reservoirs each having a different diameter and formed on the closed bottom at proper spaces in a predetermined direction in order of diameter, a sorting disc acting as an upper surface of the box body and provided with a plurality of openings corresponding to the coin reservoirs, a guide sleeve formed within the box body at a central portion thereof and having a vertical groove, an operating rod engaging with the vertical groove and extending upwardly of the box body, spring means disposed within the guide sleeve and normally biasing the operating rod upwardly, moving blade means slightly contacting an upper surface of the sorting disc and engaging a spiral groove formed in an outer peripheral surface of the operating rod, an outer surface disc overlaid on and spaced away, by a predetermined distance, from an upper surface of the moving blade means and having a coin insertion port, and a soft formative substance having a proper form mounted on the surface disc, an upper extension end of the operating rod being in opposite relation to an inner surface of a top portion of the soft formative substance. Accordingly, coins having a certain diameter (i.e., one sort of coins) are positively accumulated in the corresponding one of the coin reservoirs. Furthermore, since the soft formative substance mounted on the surface disc is expanded or contracted to change its shape, etc. when a coin is being inserted, the user's attention is attracted. As a result, the saving effect is enhanced. Moreover, the simpleness in construction of the saving box, as well as its feature for changing the shape, etc. of the formative substance creates a feel something very familiar and close to our daily life.

While the invention has been described in its preferred embodiment, it should be understood that the present invention is by no means limited to this embodiment. Obviously, many changes and modifications can be made without departing from the scope of the appended claims.

What is claimed is:

1. A saving box according comprising:

a cylindrical box body having a closed bottom;

a plurality of coin reservoirs each having a different diameter and formed on said closed bottom at proper spaces in a predetermined direction in order of diameter;

a sorting disc acting as an upper surface of said box body and provided with a plurality of openings corresponding to said coin reservoirs;

a guide sleeve formed within said box body at a central portion thereof and having a vertical groove;

an operating rod engaging with said vertical groove and extending upwardly of said box body;

spring means disposed within said guide sleeve and normally biasing said operating rod upwardly;

moving blade means slightly contacting an upper surface of said sorting disc and engaging a spiral groove formed in an outer peripheral surface of said operating rod;

an outer surface disc overlaid on and spaced away, by a predetermined distance, from an upper surface of said moving blade means and having a coin insertion port; and a soft formative substance having a proper form mounted on said surface disc, an upper extension end of said operating rod being in opposite relation to an inner surface of a top portion of said soft formative substance.

2. A saving box as claimed in claim 1, wherein said spring means is a coil spring.

3. A saving box as claimed in claim 1, wherein said moving blade means has a single blade.

4. A saving box as claimed in claim 1, wherein said moving blade means has a plurality of blades.

5. A saving box as claimed in claim 1, wherein said soft formative substance is in the form of an animal.

6. A saving box as claimed in claim 1, wherein said soft formative substance is in the form of a doll.

* * * * *